United States Patent [19]

Champeaux et al.

[11] Patent Number: 4,904,139

[45] Date of Patent: Feb. 27, 1990

[54] BINDING MACHINE

[75] Inventors: René Champeaux; Jean-Pierre Merlo, both of Bourgoin Jallieu, France

[73] Assignee: C.P. Bourq Industries S.A., La Tour du Pin, France

[21] Appl. No.: 324,831

[22] Filed: Mar. 17, 1989

[30] Foreign Application Priority Data

Mar. 21, 1988 [FR] France ..... 88 03902

[51] Int. Cl.[4] ..... B42C 9/00

[52] U.S. Cl. ..... 412/37; 412/9; 412/16

[58] Field of Search ..... 412/37, 16, 33, 25, 412/1, 9

[56] References Cited

U.S. PATENT DOCUMENTS 2,697,236 12/1954 McCain et al. ..... 412/37 X 3,956,057 5/1976 Jung ..... 412/37 X

*Primary Examiner*—Frank T. Yost

*Assistant Examiner*—Eugenia A. Jones

*Attorney, Agent, or Firm*—Sixbey, Friedman, Leedom and Ferguson

[57] ABSTRACT

A binding machine for booklets comprises:

a movable hood carried by the frame, covering the aligned stations and defining, for the carriage, an elongated passage opening, parallel to the path and whose length is equal to the course of reciprocating movement of the carriage, and a band of relatively flexible material fixed and held taut at both ends of the carriage, having a width in excess of the window and guided by the frame so that a part thereof always shuts off the window at both ends of the carriage whatever the position thereof, said band extending in a plane under the window and above the stations.

8 Claims, 4 Drawing Sheets

Fig-1
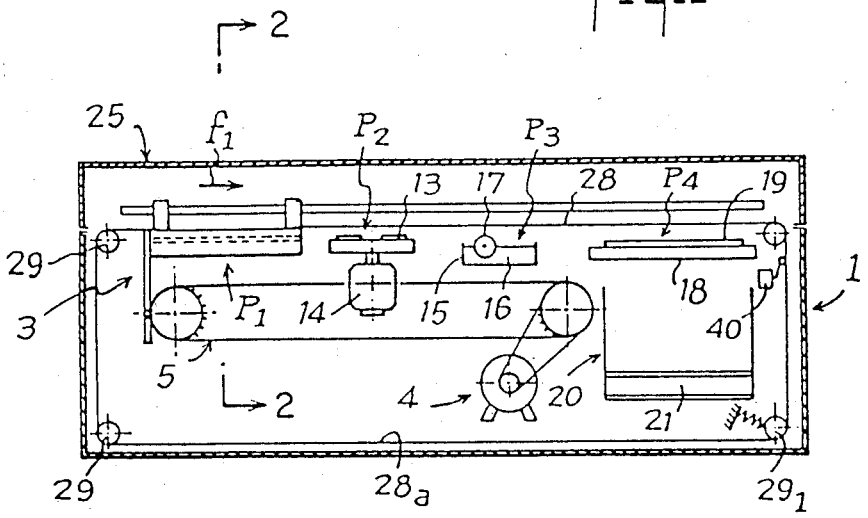
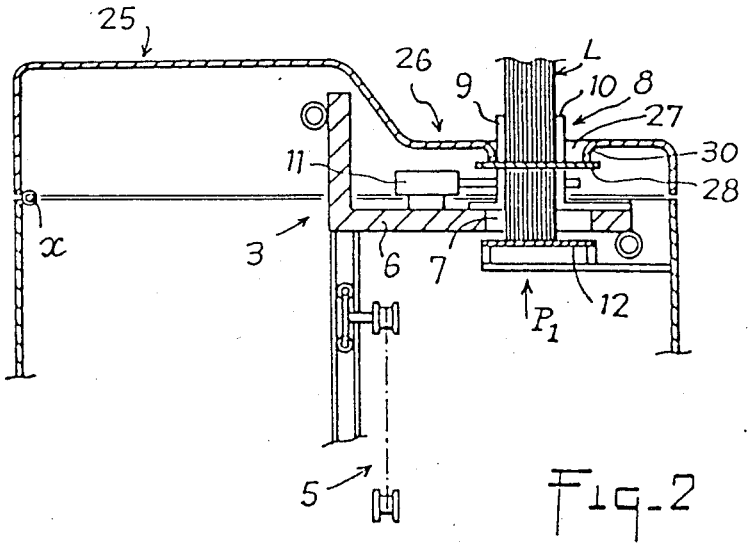
Fig-2

BINDING MACHINE

BACKGROUND OF THE INVENTION.

The invention relates to a machine for binding pages, sheets, sees of pages or sections in order to present them in a unitary assembled form while at the same time facilitating arrangement and consultation of the pages.

More specifically, the invention is concerned with binding machines joining the pages together by the application of glue and of covsr.

Such machines, which are widespread in industry, are so designed that a gripper carriage is reciprocated along different operating stations.

Generally such a machine designed in this manner comprises a first loading station at which a group of pages or sections is manually inserted between the laws of the gripper on the carriage for loading.

After the loading station there is a routing station which comprises a rotating member in order to cut into the spine of the stack of pages as the latter is moved along by the carriage. Such a station is also designed to cut grooves in the back face.

The routing station is followed by a gluing station at which the back face is coated with a layer of adhesive product which is generally applied in a liquid state after being melted.

After this gluing station the carriage moves the stack of gripped pages into alignment with an encasing station in order to align the stack of sheets with a cover which is pressed into contact with the routed and glued back face in order to ensure the fixation thereof. The encasing station is, generally, placed in alignment with a discharge conveyor. Such an encasing station comprises a sinking table and jaws, in the form of blades, adapted to press the cover on the two surfaces of the sheets in the parts thereof adjacent to the back.

Owing to the displacement of the carriage past the different successive stations the machines of this type constitute an open path flanked by independent operating stations which are made accessible as soon as the carriage is not in a position, for a given instant or temporarily, in which it is aligned with each such station.

Such a design does not comply with the safety conditions for workers having to operate the machine.

In fact, the accessibility of all the stations is a source of accidents and physical injury, which may be serious, to the workers or even to well informed and cautious maintenance engineers.

This problem has however already been seen and there have been various proposals in the prior art in order to provide a remedy. All the designs suggested have involved the use of separate hoods for each working station with the provision of a switch adapted to interrupt the supply of power to the station or otherwise prevent it from functioning if the hood should be opened.

Such means certainly make it possible to reduce the risks of accidents but they are incapable of completely eliminating the risks owing to the lack of effectiveness of the technical means used and owing to the habit of the personnel and operators of intentionally overriding the safety means in order to facilitate the operation or function of the machine or of maintenance operations thereon.

In other words it is possible to say that all the systems produced so far only lead to incomplete or ineffective security with respect to at least some of the operating stations of a binding machine operating by the application of glue and a cover.

SHORT SUMMARY OF THE INVENTION.

One object of the Present invention is to provide a solution to the above problems by the use of technical means which are capable of providing total and effective safety for all the working stations of a booklet binding machine.

A further object of the invention is to provide a safety system using simple, practical, efficient and convenient means capable of rendering access to the working stations at least prohibitively difficult if not completely impossible. A further aim of the invention is to prevent physical contact with the station of the machine which is in operation by any person, qualified or not, having to do with the machine.

A still further object of the invention is to provide security means of which some are adapted to perform a second function of positively removing the bound books produced in an orderly manner.

In order to achieve these or other objects appearing herein a machine in accordance with the invention is characterized by comprising:

a movable hood carried by the frame, covering the aligned stations and defining, for the carriage, an elongated passage window, parallel to the path and whose length is equal to the course of alternating movement of the carriage, and a band of relatively flexible material fixed and held taut at both ends of the carriage, having a width in excess of the window and guided by the frame so that a part thereof always shuts off the window at both ends of the carriage whatever the position thereof, said band extending a plane under the window and above the stations.

Various other features of the invention will appear from the following account with reference to the drawings showing, only by way of example and without any intention of limitation.

LIST OF THE SEVERAL FIGURES OF THE DRAWINGS.

FIG. 1 is a diagrammatic section and elevation of a machine embodying the invention.

FIG. 2 is a transverse section on a larger scale than FIG. 1 and taken substantially on the line II—II of FIG. 1.

FIG. 3 and

Figure 4:
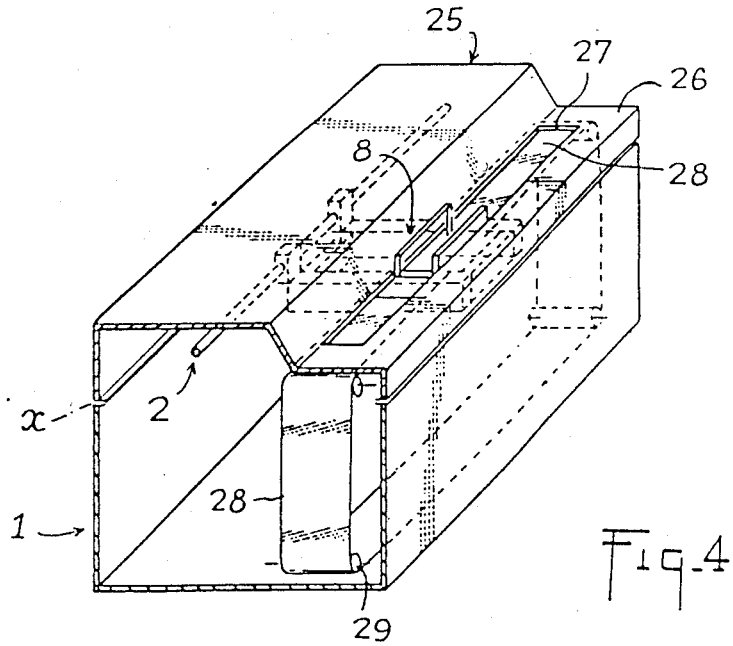

FIG. 4 are perspective views, partly in section, diagrammatically illustrating two characteristic aspects of the machine in accordance with the invention.

Figure 5:
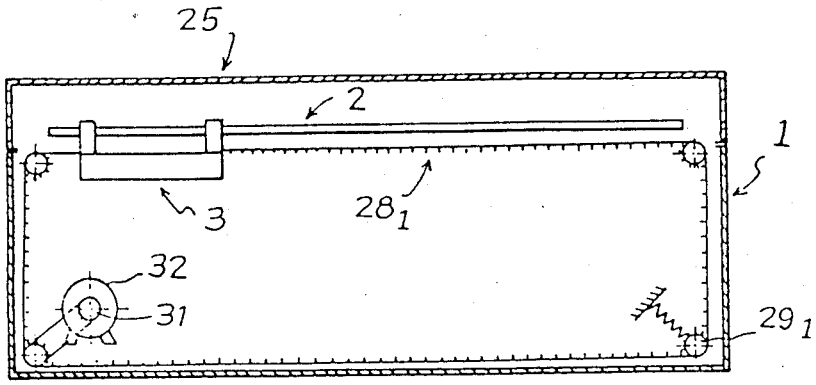

FIG. 5 is a diagrammatic section and elevation similar to FIG. 1 but illustrating a modified form of the invention.

Figure 7:
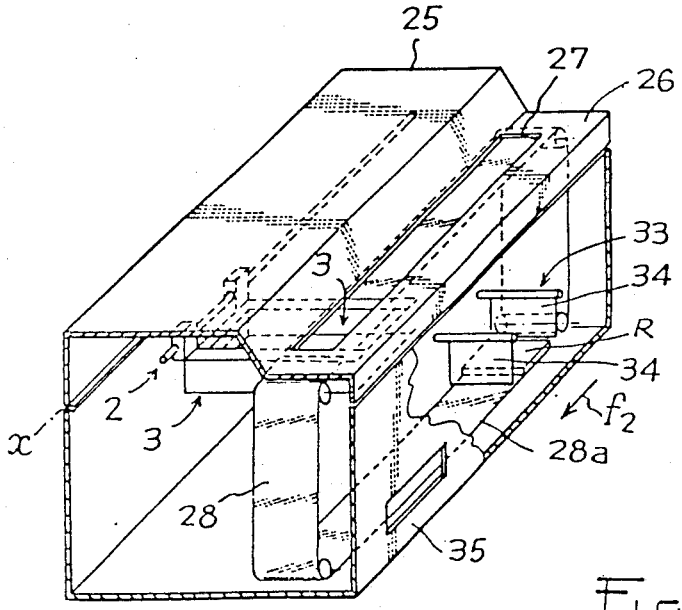
Figure 6:
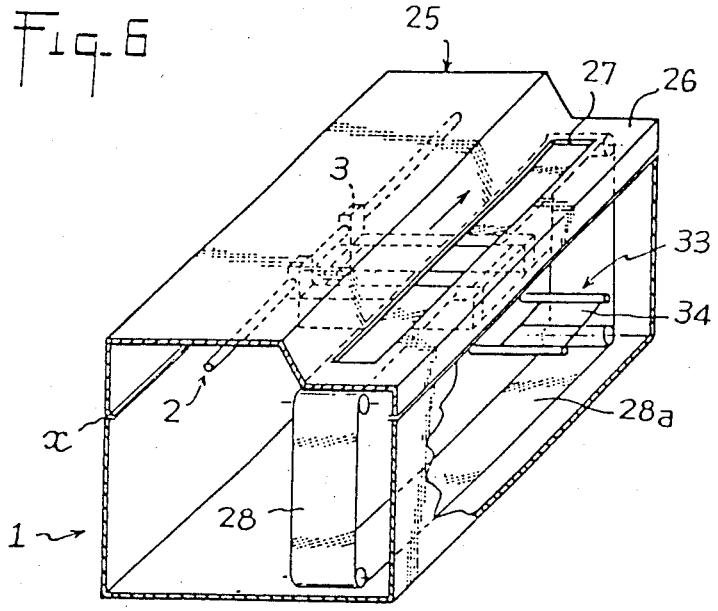
Figure 8:
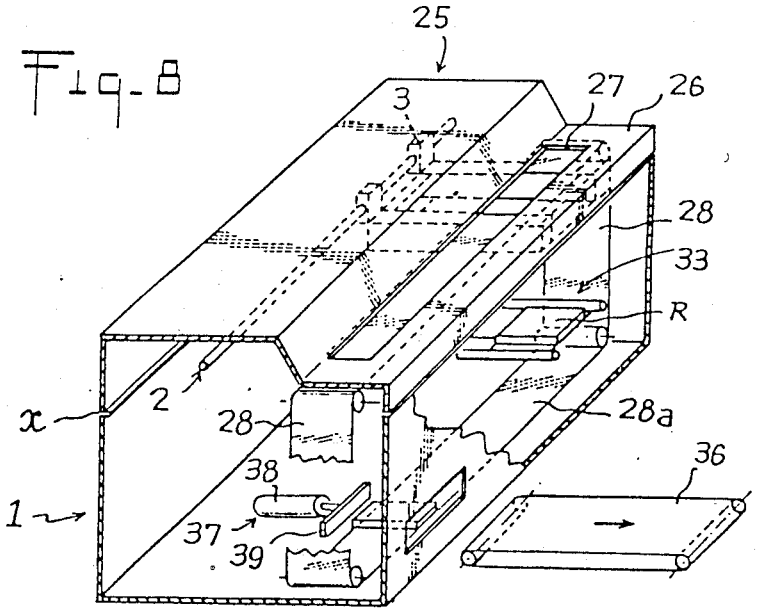

FIGS. 6 to 8 show three perspective views of further development of the design of the invention.

DETAILED ACCOUNT OF WORKING EXAMPLES OF THE INVENTION.

FIG. 1 diagrammatically shows a machine for binding sets of pages. Such a machine conventionally comprises a frame 1 defining a guide path 2 for a carriage 3 which is reciprocated by a drive motor 4 and a transmission 5 along the path to different stations.

The carriage 3 comprises a plate 6 having a load opening 7 whose edges, which are parallel to the guide path 2, are provided with a gripper 8. In a conventional manner the gripper 8 comprises a fixed jaw 9 and a moving jaw 10 which is provided with a drive member 11 which is supplied with fluid, in order to open and close the jaw 10, under the control of the means causing the cyclical function of the machine.

The guide path 2 is arranged to be parallel to the different aligned operating stations in front of which or in relation to which the carriage is to be displaced. The operating stations comprise firstly a station $P_1$ formed, as will be seen from FIG. 2, by a preparing tray 12 carried by the frame 1 so as to extend in a plane under the plate 6 and in alignment with the loading opening 7. The preparing tray 12 occupies a fixed position or may be provided with adjusting means if this is desired of if it is desirable to be able to change the distance between this table and the lower face of the plate 6.

The loading station $P_1$ is followed by a routing station $P_2$ comprising, in horizontal alignment with the preparing tray, a cutting member 13 adapted to be rotated about a vertical axis b a motor 14. In a conventional manner, the cutting member 13 is constituted by at least one router bit whose tooth profile is selected in such a manner as to perform edge trimming and the cutting of grooves on the back face of a set of sheets to be bound by gluing and the provision of a cover.

The routing station $P_2$ is followed by a gluing station $P_3$ which is aligned with the stations $P_1$ and $P_2$. The gluing station $P_3$ is preferably designed to use thermofusing adhesive and comprises a trough 15 containing a stock 16 of hot melt adhesive held at the melting temperature by a regulated heating system which is not shown. In a known manner the trough 15 is connected with a gluing cylinder 17 rotated by a motor and having part of it permanently dipping into the stock 16.

The gluing station $P_3$ is followed by an encasing station $P_4$ in which a cover is fixed in place, comprising a sinking table 18 normally placed in alignment with the other stations and adapted to receive a cover, not shown, which while flat is to be attached to a set of pages. The sinking table 18 is associated with two gripping blades 19 with means for moving them towards each other and to move them apart in step with the functional cycle of the machine.

The steps taking place in a cycle of the machine, as described above, are as follows.

The carriage 3 occupies the initial standby position in relation to the loading station $P_1$. In this position the plate 6 is placed over the preparing tray 12 and the moving jaw 10 is in its position in which it open as far as possible.

A set of documents or pages, such as indicated by the reference L in FIG. 2, is then placed between the open jaws 9 and 10 so that its back surface rests on the preparing tray 12 and the pages may be vertically aligned.

Putting the machine into operation causes the jaws 9 and 10 to close and to grip the set L of pages which is kept in a vertical position by the carriage.

The drive means 4 is then operated in order to displace the carriage in the direction indicated by the arrow $f_1$ and move it in a continuous translatory motion so as to be vertically aligned with the station $P_2$. The router 13, which is rotated b the motor 14, trims the back face of the set L in order to even it out and to simultaneously cut substantially transverse grooves as known in the bookbinding art.

The motor 4 is kept in operation in order to move the carriage in the direction of the arrow $f_1$ so that the entire length of the back face of the set of pages is moved along past the station $P_2$. The carriage 3 then moves the set of pages L to the station $P_3$ Where it comes into engagement with the gluing cylinder 17 driven in rotation. The relative motion of the set L causes the deposit of a layer or film of the melted glue covering the entire face of the back of the set L and penetrating into the grooves cut therein in order to cause the pages to be joined together when the glue hardens.

The set L of pages is then transferred by the carriage 3 to a position over the station $P_4$ which has previously been provided with a flat cover placed on the table 18. The carriage is stopped when it is aligned with the table 18 which is raised into order to apply the cover to the back face so as to promote solidification of the glue and the creation of a connection between the set L and the cover. After lifting the table 18 the blades 18 are moved towards each other to bend the flat parts of the cover onto the two sides of the back and to produce a glued joint.

The jaws 9 and 10 are then opened and simultaneously the table 18 is lowered in such a manner that the bound booklet in the form of the cover and the set L of pages falls under its own weight onto a conveyor 20 placed vertically under the station 4 in order to guide the booklet towards the exit port 21.

Generally, the guide path 2 and the different stations $P_1$ to $P_4$ are arranged along a straight line.

In order to provide effective security for the operator or operators or persons servicing the machine, so that there s no chance of injury by the stations $P_1$ to $P_4$, in accordance with the invention the machine comprises an upper hood 25, which is preferably in the form of a casing, able to pivot about an axis x parallel to the path 2. The hood 25 constitutes an enclosure 26 covering the group of stations $P_1$ to $P_4$ while at the same time forming an integral part of the frame 1 The enclosure 26 defines an elongated window 27 whose width is selected to be equal to somewhat more than the maximum width of the gripper 8, whose jaws are to be reached through the window. The length of the elongated window 27 is equal to the maximum reciprocation displacement of the carriage 3 between the stations $P_1$ and $P_4$.

In accordance with a further feature of the invention the carriage 3 is extended on both its transverse sides by a band 28 placed in a plane under the enclosure 26, vertically aligned with the window 27, in order to cover all the moving parts of the stations $P_1$ to $P_4$ whatever the position of the carriage 3 may happen to be. The band 28 is made of a relatively soft material, preferably reinforced, in such a manner as to constitute the form of an endless loop running over idler rollers of which at least one, as for instance the roller $29_1$ is able to be moved to adjust the tension of the band. The band 28 has a length greater than that of the window 27.

Figure 3:
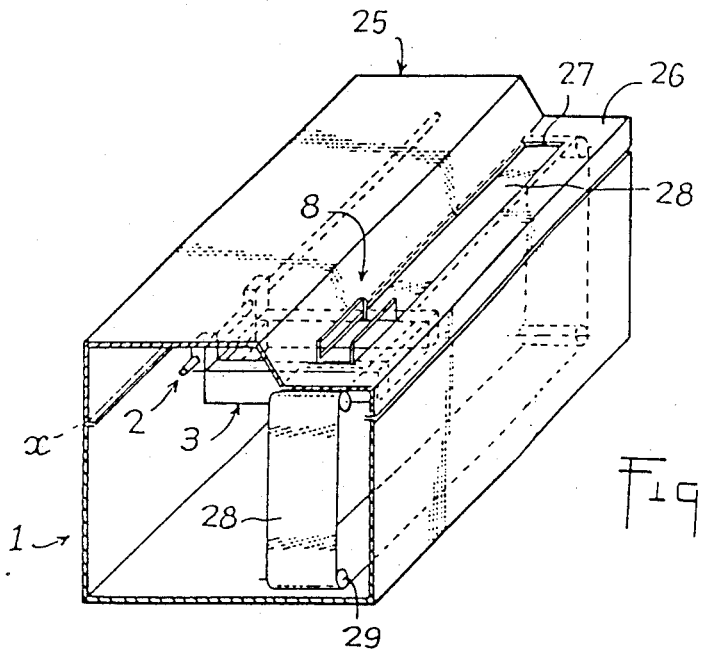

As will be seen from an examination of the FIGS. 3 and 4, the band completely shuts off the opening of the window 27 by being placed between the enclosure 26 and the moving members of the different stations $P_1$ to $P_4$. As the carriage is moved in the one or the other direction between the stations $P_1$ to $P_4$, the band is moved along past the stations and completely shuts off the window 27 so that if it is not possible, or is at least very hard to obtain access to the moving members of the stations $P_1$ to $P_4$.

The band 28 is for instance made of reinforced woven polyester fiber.

In accordance with a preferred feature of the invention, along the rim of the thereof the enclosure 26 comprises a flange border 30 directed in a downward direction and against which the band 28 is urged.

In accordance with an advantageous design feature of the invention the band 28 is in the form of a ribbed belt $28_1$ as illustrated in FIG. 5. In such a case one of the rolls 29 is ribbed and is positively driven by the output shaft 31 of an electric motor 32. In this manner the band 28 assumes the first function as described above and also the function of a transmission and the function of operating the carriage 3 in place of the transmission 5. It is thus possible for a simpler and more feasible design which is less trouble to be used.

A further feature of the invention is shown in FIG. 6 in which the base of the conveyor 20 is to be seen which may be equipped with a trap door 33 defining a receiving plane placed above the lower run 28*a* of the band 28. The trap door 33 may be designed in a number of different ways, more especially in the form of two panels 34 caused to partially rotate in step with the cycle of displacement of the carriage 3. More specifically, the pivoting of the panels 34 is caused to take place when the carriage 3 has been returned to the loading station P after a complete working cycle. In this way the trap door 33 ensures the reception of the bound booklet which has just been produced and supports it during the return motion of the carriage 3 towards the station $P_1$. When this station is reached the trap door 33 opens and places the complete booklet on the lower run 28*a* which at this moment is stationary.

During the following cycle the lower run 28*a* is moved successively in the direction of the arrow $f_2$ (FIG. 7) and transfers the complete booklet as is referenced R, from the base of the removing conveyor 20 as far as the exit port 35 of the frame 1 substantially aligned with the loading station $P_1$ where the machine operator normally stands or sits.

When the carriage 3 is in the neutral stationary position aligned with the encasing station, the run 28*a* is halted and the bound booklet R is placed opposite to the exit port 35. The removal of the bound booklet R may be undertaken manually or be caused automatically towards a an ejecting draw rod 37 comprising, for example, an actuator 38 moving a thrust or traction bar 39.

As will be seen from the description, the system of the invention makes use of simple technical operating means which are sturdy, practical, trouble-free and effective and may be use d with all the operating stations of such a machine.

In a supplementary manner the means in accordance with the invention make possible a simplification of the operating members in cases in which the band 28 assumes a dual function as has been described in connection with FIG. 5.

Furthermore the means in accordance with the invention make it possible to automate the cycle of functions of the machine by facilitating the loading and unloading of the machine by a single operator responsible for the machine, that is to say the input and the removal of the bound booklet produced.

The invention is furthermore not restricted to the described and illustrated examples thereof, for various modifications may be made in it without leaving the scope of the invention.

We claim:

1. A book binding machine for binding sets of pages by gluing and the application of a cover, comprising a frame defining a straight guide path supporting a carriage which is adapted to be loaded with a set of pages and is coupled with a drive member adapted to reciprocate the carriage along the path, the said frame supporting in relation to the path a carriage loading station for charging the carriage with a set of such pages so as to be supported vertically by the carriage, a routing station for routing the back surface of the set of pages, a gluing station for applying adhesive to the routed back surface of the set, an encasing station for applying the cover on the back routed surface to which adhesive has been applied, in a cover and a discharge conveyor, said machine further comprising:

a movable hood carried by the frame, covering the aligned stations and defining, for the carriage, an elongated passage window, parallel to the path and whose length is equal to the course of reciprocating movement of the carriage, and a band of relatively flexible material fixed and held taut at both ends of the carriage, having a width in excess of the window and guided by the frame so that a part thereof always shuts off the window at both ends of the carriage whatever the position thereof, said band extending in a plane under the window and above the stations.

2. The machine as claimed in claim 1 wherein the window is bordered by a flanged peripheral rim directed downwards and against which the band is tensioned.

3. The machine as claimed in claim 1 wherein the band is in the form of a closed loop.

4. The machine as claimed in claim 3 wherein the band is supported by hand rolls of which one is provided with means for tightening the band.

5. The machine as claimed in claim 3 wherein the band has a lower run extending below a trap door to shut off the lower run between the trap door and an exit port provided in the frame.

6. The machine as claimed in claim 5 wherein the trap door is caused to open during each cycle of reciprocating movement of the carriage after the return of the latter to the loading station.

7. The machine as claimed in claim 5 wherein the exit port is provided with an actuator operated during each cycle of movements of the carriage after the arrival of the latter in the encasing station, in order to move a page set carried by the lower run, transversely in relation to the latter, through the port towards an exit station.

8. The machine as claimed in claim 1 wherein the band is in the form of a ribbed belt running on a ribbed pulley mounted on an output shaft of a drive member able to be reversed in direction and thus constituting a closure for the window and an entraining transmission for the carriage in order to cause it to perform its reciprocating movement.

* * * * *